United States Patent [19]

Miyazawa

[11] Patent Number: 4,916,676

[45] Date of Patent: Apr. 10, 1990

[54] ELECTRONIC TIMEPIECE

[75] Inventor: Osamu Miyazawa, Suwa, Japan

[73] Assignee: Seiko Epson Corporation, Tokyo, Japan

[21] Appl. No.: 282,240

[22] Filed: Dec. 9, 1988

[30] Foreign Application Priority Data

| | | | |
|---|---|---|---|
| Dec. 14, 1987 | [JP] | Japan | 62-315612 |
| Dec. 23, 1987 | [JP] | Japan | 62-325691 |
| Aug. 24, 1988 | [JP] | Japan | 63-209984 |

[51] Int. Cl.[4] ..... G04B 19/04; G04B 15/00

[52] U.S. Cl. ..... 368/80; 368/128

[58] Field of Search ..... 365/76, 80, 124–128, 365/155–157, 160, 163, 168

[56] References Cited

U.S. PATENT DOCUMENTS

| | | | |
|---|---|---|---|
| 3,002,336 | 10/1961 | Lovegrove | 368/127 |
| 3,779,093 | 12/1973 | Hetzel | 368/125 |
| 3,901,213 | 6/1976 | Koike et al. | 368/168 |
| 3,978,654 | 9/1976 | Koike et al. | 368/80 |

*Primary Examiner*—Vit W. Miska

*Attorney, Agent, or Firm*—Blum Kaplan

[57] ABSTRACT

An electronic timepiece is provided having a display. An actuator provides rotational energy for driving the display. An energy storage unit stores the energy of the actuator and applies it to the display. A link connects the actuator to the display. A control unit connected to the display by a second link controls the driving the display by controlling the application of energy to the display by the storage unit. The control unit includes a magnet, a power generating yoke and a power generating coil about the yoke.

13 Claims, 3 Drawing Sheets

ELECTRONIC TIMEPIECE

BACKGROUND OF THE INVENTION

The present invention relates generally to an electronic timepiece, and in particular to controlling the display of an analog electronic timepiece.

It is known to control the sweep hand of an analog electronic timepiece as disclosed in U.S. Pat. No. 3,961,213. Reference is made to FIG. 1 wherein such a conventional timepiece is provided. The intermittent rotational energy of an actuator is stored by the attractive magnetic forces of a drive magnet 51. Drive magnet 51 is coupled to a fourth wheel and pinion 59 which is supported on a gear plate 60 by one end of its axis 58. Within a bridge 56 supporting the other end of axis 58, a cavity 61 sealed by cap 55 contains a viscous fluid 54. A driven magnet 53 is immersed in the viscous fluid 54 and is magnetically coupled to drive magnet 51. Driven magnet 53 rotates smoothly due to the viscous resistance between bridge 56 and driven magnet 53 provided by viscous fluid 54.

A second hand shaft 57 is freely rotatably mounted in a conventional manner. A follower magnet 52 is mounted on one end of second hand shaft 57 and magnetically interlocks with driven magnet 53 to smoothly rotate second hand shaft 57.

The prior art electronic timepiece has been satisfactory. However, because the viscous resistance of viscous fluid 54 varies with temperature, the time indicated by the second hand will also deviate with temperature because of a change in the relationship of the viscous resistance and the attractive force of the magnets. As the temperature decreases the viscous resistance becomes too large with respect to the magnetic attractive force. Additionally, it has been noticed that it is difficult to completely seal the fluid so that fluid leakage occurs, changing the characteristics of the sweep hand. Because the rotational characteristics of the shaft and hand are determined by the attractive forces of magnet 52 and the viscous resistance of fluid 54, there is a wide range of variety in performance of the sweep hand among the different manufactured products which is extremely difficult to adjust to provide a uniform sweep hand characteristic.

Accordingly, it is desirable to provide a control for the display in an electronic timepiece which overcomes the shortcomings of the prior art devices described.

SUMMARY OF THE INVENTION

Generally, an electronic timepiece includes a time counting circuit for intermittently driving an actuator. A storage unit stores the rotational energy of the actuator. A display is linked to the storage unit which provides the energy for driving the display. A control unit for controlling driving the display is also linked to the display. The control unit includes a magnet having at least more than two poles. The magnet is contained within a power generating yoke and is connected to a power generating coil.

In another embodiment of the invention the control unit provides an output to a power source. The power source provides an output to the time counting circuit.

Accordingly, it is an object of the invention to provide an improved control for the sweep hand of an electric analog timepiece.

Another object of the invention is to provide an analog timepiece in which the display does not vary due to changes in temperature.

Yet another object of the invention is to provide an electronic timepiece which exhibits only slight changes in display characteristics which can be easily compensated.

Still another object of the invention is to provide an electronic timepiece in which the sweep hand may be easily set for either a stepped mode or sweep mode.

A further object of the invention is to provide an electronic timepiece which includes storing rotational energy of the actuator which is intermittently driven by a time counting circuit and providing it to a display through a first link and control unit for smoothly driving the display through a second link and providing a control unit which includes at least a magnet, a power generating yoke and a power generating coil.

Still another object of the invention is to provide an electronic timepiece constructed of a time counting circuit for intermittently driving an actuator, a power source for providing power to the time counting circuit, a storage unit for storing rotational energy of the actuator and providing it to a display through a first link and a control unit for smoothly driving the display through a second link and the control unit being constructed of a power generating coil and a rectifying circuit for supplying its output current to the time counting circuit through the power source.

Still other objects and advantages of the invention will in part be obvious and will in part be apparent from the specification and drawings.

The invention accordingly comprises the features of construction, a combination of elements and arrangement of parts which will be exemplified in the constructions hereinafter set forth and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
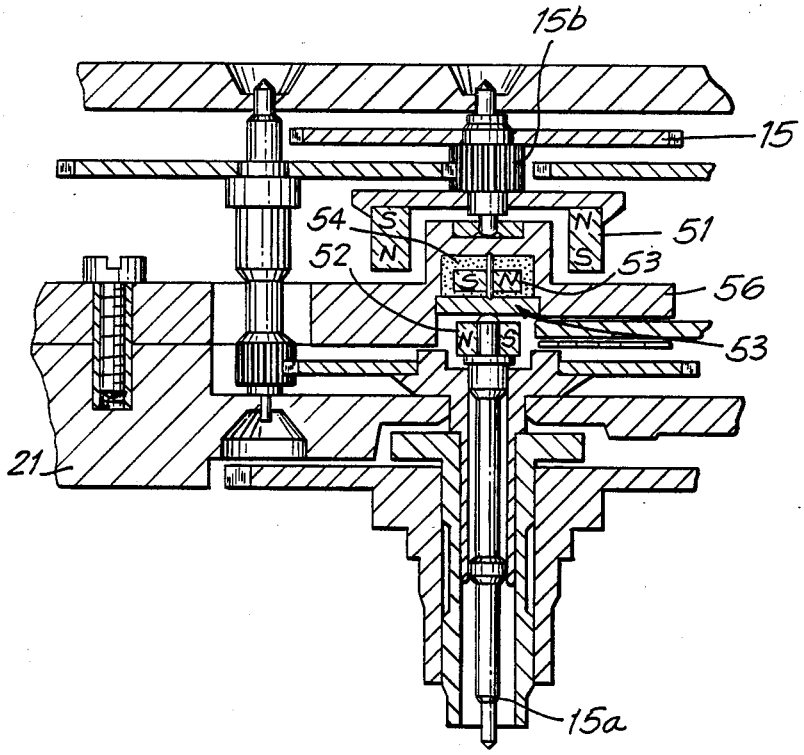
FIG. 1 PRIOR ART
FIG. 1 is a sectional view of an electronic timepiece constructed in accordance with the prior art.
Figure 2:
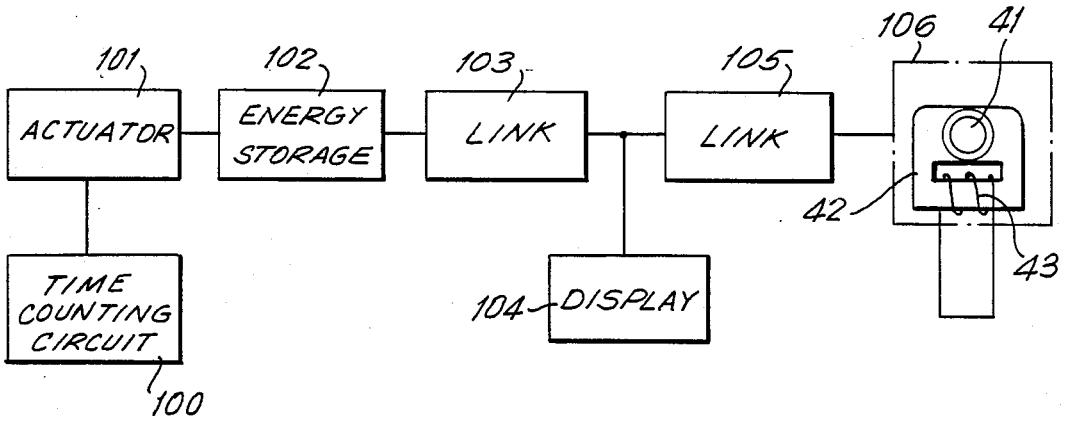
FIG. 2 is a block diagram of an electronic timepiece constructed in accordance with a preferred embodiment of the invention.

Reference is made to FIG. 2 wherein an electronic timepiece, generally indicated at 99, constructed in accordance with the invention is provided. A time counting circuit 100 intermittently drives an actuator 101. An energy storage unit 102 stores the intermittent rotational energy of actuator 101. A display device 104, such as a watch hand is connected to energy storage unit 102 through a link 103 so that energy storage unit 102 drives display device 104. A control device 106 is connected to display 104 through a second link 105.

Control device 106 controls display 104 through link 105 by causing the energy stored in energy storage unit 102 to be slowly released so that display device 104 is driven slowly to produce a sweep motion in the watch hand.

Control device 106 includes a magnet 41 having more than two poles. A power generating yoke disposed about magnet 41 closes the magnetic flux path of magnet 41. A power generating coil 43 surrounds yoke 42 and is short circuited at its ends. Magnet 41 is operationally connected to link 105. When magnet 41 is driven by second link 105, magnetic flux in power generating yoke 42 changes and induction current flows through power generating coil 43. As the rotary torque applied to magnet 41 is proportional to the speed of change of the magnetic flux, i.e., the rotational speed, control unit 106 applies a load torque to display 104 in proportion to the rotational speed of magnet 41.

Figure 3:
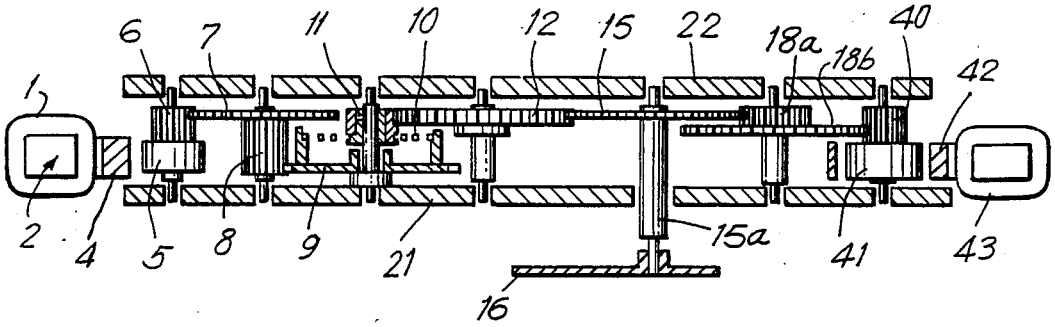
FIG. 3 is a sectional view of an electronic timepiece constructed in accordance with the invention.

Reference is now made to FIG. 3 in which one embodiment of electronic timepiece 99 is shown. Electronic timepiece 99 includes a wheel train bridge 22 disposed at a distance from a main plate 21. A step motor is utilized as an actuator 101. A coil 1 wrapped about a magnetic core 2 generates a magnetic field which acts upon a stater 4 to drive a rotor 5 which is rotatably mounted between wheel train bridge 22 and main plate 21.

A sixth pinion 6 is affixed to stater 5. A fifth gear wheel coupled to a fifth pinion 8 engages sixth pinion 6. A gear wheel 9 is rotatably mounted on the same axis 11*a* as a pinion 11. Gear wheel 9 is linked to pinion 11 by a hairspring 10 which acts as energy storage unit 102. The energy of actuator 101 is stored by the elastic deformation of hairspring 10. An idler 12 which engages pinion 11 also engages a fourth wheel 15 which rotates a second hand shaft 15*a* which carries a hand 16. Gear wheel 9, pinion 11, idler 12 and fourth wheel 15 act as first link 103 for decelerating the rotation of the step motor.

An acceleration pinion 18*a* and acceleration gear wheel 18*b* are coaxially mounted on and coupled to a shaft 18*c* supported between plate 21 and bridge 22. Acceleration pinion 18*a* engages fourth wheel 15. A magnet pinion 40 fitted in magnet 41 meshes with acceleration gear wheel 18*b*. Magnet 41 is positioned in and magnetically interlocked with yoke 42. A short circuiting current flows through power generating coil 43 wrapped about yoke 42 to control fourth wheel 15. Fourth wheel 15, acceleration pinion 18*a* and magnet pinion 40 are the second link 105. This structure allows the rotational energy stored by hairspring 10 to be gradually released to smoothly drive hand 16.

Figure 4:
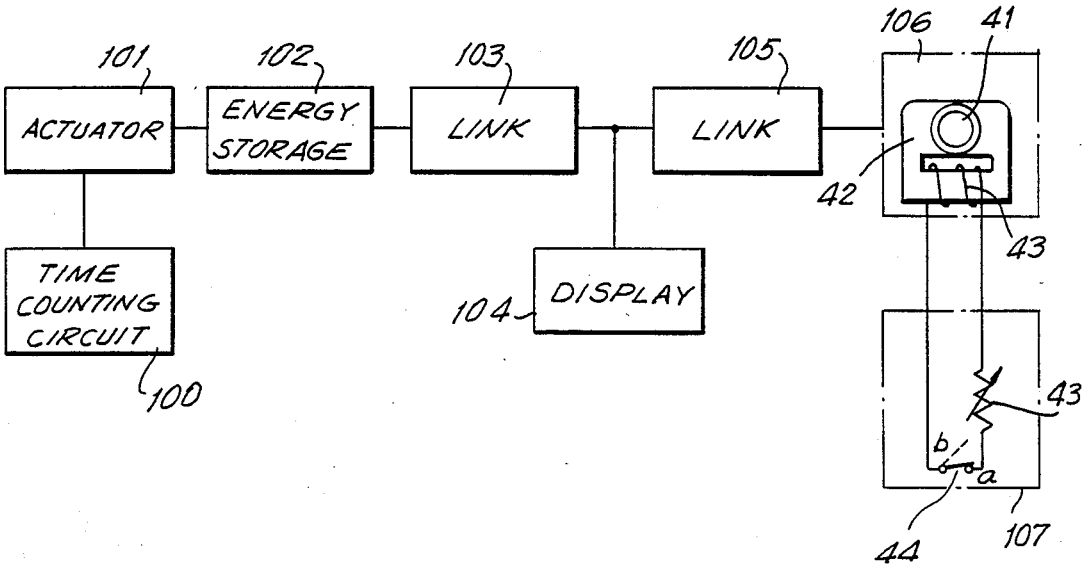
FIG. 4 is a block diagram of a second embodiment of an electronic timepiece constructed in accordance with the invention.

Reference is now made to FIG. 4 in which a second embodiment of the electronic timepiece, generally indicated at 110, is provided. An additional control for control device 106 is provided. A control circuit 107 controls control device 106. Control circuit 107 includes a variable resistor 45 in series with a switch 44. Circuit 107 is connected at both ends of power generating coil 43.

Control circuit 107 makes it possible to adjust the torque load of control device 106 by adjusting the short circuiting current. Control circuit 107 also makes it possible to select stepped hand motion by eliminating the torque load in accordance with the rotational speed of magnet 41 by interrupting the short circuiting current with switch 44 by moving switch 44 to the open position, by pivoting the switch at hinge b shown in phantom. It is also possible to provide a complete sweep motion of the second hand and a motion substantially equal to a stepped one, as needed, by optionally adjusting variable resistor 45 with switch 44 in the closed position against contact a.

It should be noted that although the instant embodiment has been described with respect to using variable resistor 45 as control circuit 107, it is also possible to use a capacitor or a coil for phase shifting or a filter that makes the load torque dependent on the rotational speed of the magnet. Moreover, switch 45 may be an electronic switch using a transistor. Additionally, an electronic current may be applied to power generating coil 43 to generate a magnetic force controlling magnet 41. This structure easily provides any desired hand movement mode because the characteristics of control device 106 can be changed electrically.

Figure 5:
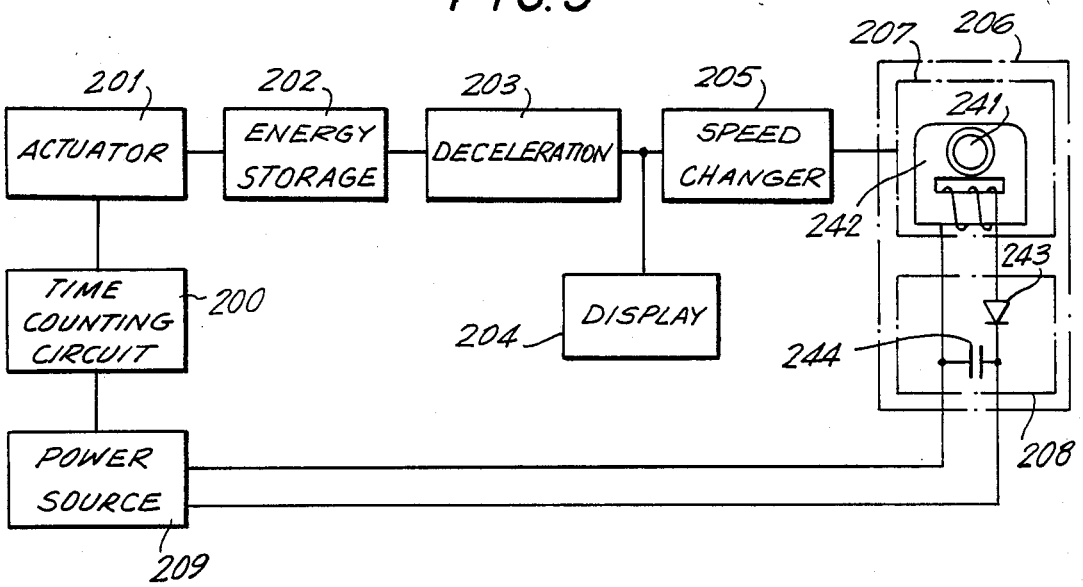
FIG. 5 is a block diagram of an electronic timepiece constructed in accordance with a third embodiment of the invention.

Reference is now made to FIG. 5 wherein a third embodiment of an electronic timepiece, generally indicated at 199, is provided. Electronic timepiece 199 includes a time counting circuit 200 which intermittently drives an actuator 201. An energy storage unit 202 stores the intermittent rotational energy of actuator 201. A display 204 is connected to energy storage unit 202 by a link 203 so that display device 204 is driven by link 203.

A control device 206 is connected to display 204 through a second link 205. Control device 206 causes the stored rotational energy of energy storage unit 202 to be gradually released so that display device 204 is driven smoothly to provide a sweep hand mode. A power source 209 drives actuator 201 through time counting circuit 200. In an exemplary embodiment power source 209 includes a primary battery such as a silver battery or a secondary battery such as a capacitor. An electric current generated by control device 206 is supplied to power source 209 to reduce the consumption of the electric charge within power source 209.

Control device 206 includes a magnet 241 which is magnetized to more than at least two poles. Magnet 241 is mounted within power generating yoke 242, which defines paths for the magnetic flux of magnet 241. A power generating mechanism 207 is formed of a power generating coil 211 wrapped about yoke 242 and the magnetic circuit. A rectifying circuit 208 coupled to coil 211 includes a rectifying element 243 and a capacitor 244. A voltage proportional to the speed of magnet 241 is induced by the changes in the magnetic flux in power generating yoke 242 due to the driving of magnet 241 by second link 205.

The generated current is rectified through rectifying element 243 and circulated through power source 209 after it has been smoothed by capacitor 244. It thus becomes possible to reduce the amount of current flowing through time counting circuit 200 which would otherwise by generated by the battery forming power source 209. To prevent an adverse effect resulting from a reverse flow of the current circulated to the battery, a reverse flow preventive diode is added to the circuit. On the other hand, when power source 209 is formed with a secondary battery, the battery may be charged with the circulating current and smoothing capacitor 244 may be eliminated.

The electric current generated by the above arrangement in coil 211 has an amplitude proportional to the speed of magnet 241 and is rectified by rectifying circuit 208. It follows that the current flowing to power source 209 and the resultant rotary torque are proportional to the speed of magnet 241. The higher the rotational speed of magnet 241, the larger the amount of power generated and the torque load. Conversely, when the rotational speed of magnet 241 decreases, the amount of current flowing to power source 209 decreases and consequently the torque load decreases. Accordingly, control means 206 hinders the variation of the rotational speed of magnet 241 resulting in control means 206 controlling the release of the rotational energy stored in energy storage unit 202 through speed changer 205 and decelerator 203 so that the energy is smoothly released and display device 204 is driven continuously.

Control unit 206 includes a rectifying circuit 208 which consists of a single rectifying element 243 and a single smoothing capacitor 244 for half wave rectification. This is by way of example only and rectifying circuit 208 may also be in the form of a full wave rectifying circuit, a stabilization circuit or an upconversion circuit.

Additionally, even though the torque load exhibits some pulsation, because the pulsating cycle is shortened by acceleration, it is possible to operate the display device with a sufficient appearance of smoothness.

In the above embodiments, a step motor was used as the actuator. This is also by way of example only and the present invention is not limited to a step motor. A reciprocating element using a piezoelectric element or an electrostatic motor may also be used as the actuator. Additionally, the use of a hairspring as the energy storage unit is by way of example. Other storage constructions such as utilizing the attractive force or repulsive force of a magnet may be used if it is able to store rotational energy. The invention is directed to gradually releasing stored rotation energy of the power generating mechanism and to reduce the amount of current consumption by the system by circulating the generated current through the power source. Accordingly, the specific embodiments defined above are in no way limiting.

By providing an actuator and energy storage unit linked to the display and a control unit linked to the display which is not constructed with a viscous liquid, correct time may be kept even during temperature variations. Additionally, there are no problems with fluid leakage. By providing a control device including a magnet, yoke and power generating coil, the torque load may be easily adjusted and it becomes easy to select a desired hand-operating mode; either a stepped mode or sweep mode. By circulating an output current from the control device through the power source total power consumption is decreased thereby extending the life of the timepiece.

It will thus be seen that the objects set forth above, and those made apparent from the preceding description are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic timepiece comprising:

display means for displaying the passage of time;

actuator means for providing rotational energy for driving the display means;

link means for connecting said display means to said actuator means;

energy storage means connecting said actuator means to said display means for storing the rotational energy produced by said actuator means and providing the stored energy to said display means;

control means for controlling the driving of said display means by controlling the application of rotational energy thereto, said control means including a magnet, a power generating yoke and a power generating coil about said yoke, whereby said display means is smoothly driven; and second link means for connecting said display means to said control means.

2. The electronic timepiece of claim 1, further comprising time counting means for intermittently driving said actuator.

3. The electronic timepiece of claim 1, wherein the actuator is a step motor.

4. The electronic timepiece of claim 1, wherein the first link means includes a gear wheel, pinion and idler gear.

5. The electronic timepiece of claim 1, wherein the storage means includes a hairspring.

6. The electronic timepiece of claim 1, wherein the second link means includes an acceleration pinion and gear and magnet pinion.

7. The electronic timepiece of claim 1, further comprising second control means for controlling the operation of said first control means.

8. The electronic timepiece of claim 7, wherein the second control means includes a variable resistor and switch in series with said power generating coil.

9. The electronic timepiece of claim 2, further comprising a power source for providing power to said time counting means, the power source receiving a current from said control means.

10. The electronic timepiece of claim 9, wherein the control means includes rectifying means for rectifying the current in the power generating coil for application to said power source.

11. The electronic timepiece of claim 10, wherein the rectifying means includes a rectifying element and a capacitor.

12. The electronic timepiece of claim 9, wherein said power source includes a battery or capacitor.

13. An electronic timepiece comprising:

display means for displaying the passage of time;

a gear bridge, a gear wheel, a pinion for meshing with said gear wheel, an idler meshing with said pinion, the gear wheel pinion and idler being supported within the bridge;

a step motor for driving said gear wheel, pinion and idler gear, the display means being connected to the idler, whereby the drive means is connected to the step motor by the gear wheel, pinion and idler gear;

a hairspring operationally connected to the step motor for storing the rotational energy of the step motor and connected to the gear wheel and pinion for driving the display means;

control means for controlling the driving of said display means by controlling the application of rotational energy to the display means, said control means including a magnet having at least more than two poles, a power generating yoke and a power generating coil about said yoke, whereby said display means is smoothly driven;

an acceleration pinion and magnet pinion supported on the gear bridge, said acceleration pinion meshing with said magnet pinion, for connecting the control means to the display.

* * * * *